United States Patent [19]

Mitani et al.

[11] Patent Number: 4,569,206

[45] Date of Patent: Feb. 11, 1986

[54] INDIRECT COOLING REFRIGERATOR WITH FREEZING AND STORAGE CHAMBERS AND A FORCED AIR CIRCULATING PATH

[75] Inventors: Akio Mitani; Takao Ariga, both of Yokohama, Japan

[73] Assignee: Kabushiki Kaisha Toshiba, Kawasaki, Japan

[21] Appl. No.: 608,091

[22] Filed: May 8, 1984

[30] Foreign Application Priority Data

May 16, 1983 [JP] Japan ..... 58-85250
Mar. 31, 1984 [JP] Japan ..... 59-63511

[51] Int. Cl.[4] ..... F25D 21/06
[52] U.S. Cl. ..... 62/156; 62/276
[58] Field of Search ..... 62/151, 156, 152, 272, 62/275, 276, 277, 278, 285; 236/68 C; 251/11, 305

[56] References Cited

U.S. PATENT DOCUMENTS 4,246,918 1/1981 Dean ..... 251/305

FOREIGN PATENT DOCUMENTS 0053002 6/1982 European Pat. Off. .
52-131244 11/1977 Japan .
57-125980 8/1982 Japan .
2084250 4/1982 United Kingdom .
2107829 5/1983 United Kingdom .

OTHER PUBLICATIONS

Nikkei Mechanical, Sep. 29, 1982, p. 30.

*Primary Examiner*—Harry Tanner
*Attorney, Agent, or Firm*—Oblon, Fisher, Spivak, McClelland & Maier

[57] ABSTRACT

A refrigerator with a freezing chamber has a freezing chamber, and cooling chamber having a forced air circulating path provided adjacent to the freezing chamber for intaking the air in the freezing chamber, cooling the intaken air by an evaporator and returning the cooled air to the freezing chamber. A damper plate for cutting off the air circulating path during the defrosting period of the evaporator is provided. The ON and OFF of this damper plate are controlled in response to the status change of the shape memory alloy memory which takes different statuses above and below a predetermined temperature.

14 Claims, 17 Drawing Figures

INDIRECT COOLING REFRIGERATOR WITH FREEZING AND STORAGE CHAMBERS AND A FORCED AIR CIRCULATING PATH

BACKGROUND OF THE INVENTION

The present invention relates to a refrigerator with a freezing chamber and, more particularly, to a refrigerator with a freezing chamber capable of preventing the temperature in the freezing chamber from rising by a simple structure when frost adhered to an evaporator is removed.

As a system for cooling a freezing chamber in a refrigerator with a freezing chamber and a storage chamber, a direct cooling type in which an evaporator is arranged directly in a freezing chamber, and so-called an indirect cooling type employing a cooling air forced convection system in which a cooling chamber having an air circulating path containing an evaporator is provided adjacent to a freezing chamber and the air in the freezing chamber is circulated by a convection fan through the air circulating path are known. Since the indirect cooling system employs the cooling air forced convention system, it has an advantage that the air in the freezing chamber can be uniformly cooled in a short time. Even in this indirect cooling system, frost on the surface of an evaporator provided in the air circulating path should be frequently removed.

A defrosting of the surface of an evaporator is in general executed by heating the evaporator by a defrosting heater. However, in a conventional refrigerator with a freezing chamber of indirect cooling type, an air convection occurs between the freezing chamber and the air circulating path at the defrosting time, resulting in a rise in the temperature of the freezing chamber. This arises a problem that foodstuffs cannot be contained in the freezing chamber at the defrosting time.

In order to eliminate such drawbacks, it has been proposed to provide a damper which opens and closes the air circulating path in the path to drive the damper plate to the closed position, i.e., to the position for closing the air circulating path at the defrosting time, thereby preventing the air convection between the freezing chamber and the circulating path so as to prevent the freezing chamber from rising at its temperature at the defrosting time.

However, since the damper plate is opened and closed by a solenoid in the conventional refrigerator with a freezing chamber having the above-described damper plate, a damper drive mechanism is large in size and expensive, thereby disadvantageously causing an expensive refrigerator.

SUMMARY OF THE INVENTION

Accordingly, it is an object of the present invention to provide a refrigerator with a freezing chamber capable of simplifying a damper plate drive mechanism, reducing in size, facilitating the control of a defrosting, and decreasing an electric power necessary for defrosting.

According to the present invention, there is provided a refrigerator with a freezing chamber which comprises a freezing chamber; a storage chamber; a partition wall provided between the freezing chamber and the storage chamber; and a cooling chamber for forming a forced air circulating path of an air inlet provided adjacent to the freezing chamber for intaking air in the freezing chamber, an inlet air path for passing the intaken air, an evaporator for cooling the intaken air and having a defrosting heater, a cooled air path for passing the cooled air, an air outlet for exhausting the cooled air to the freezing chamber, and a convection fan for circulating the air. This forced air circulating path includes a damper plate for opening and closing the circulating path, damper plate supporting means for supporting the damper plate in the opened or closed state, and damper plate drive means for driving the damper plate to the opened position at the cooling time of the freezing chamber and to the closed position when frost adhered to the surface of the evaporator is removed by means of a shape memory alloy member.

The shape memory alloy member displaces from a first status to a second status when the member is heated to its status changing temperature or higher, and displaces from the second status to the first status when the member is cooled to the status changing temperature or lower. Therefore, this shape memory alloy member can be displaced from the first status to the second status by heating the member by means of an electric heater to control the damper plate to the closed position and to control the damper plate to the opened position by changing the alloy member from the second status to the first status by cooling the member by means of the evaporator. Since the shape memory alloy member and the electric heater are simply associated in this manner so as to control the opening and closing of the damper plate, the damper drive mechanism can be remarkably reduced in size as compared with that using a solenoid, and the inexpensive refrigerator with a freezing chamber can be produced. Further, energy of the electric heater used for controlling the damper plate can be also used for the defrosting energy, and part of the heat energy used for the defrosting can be used for the damper plate control energy.

DETAILED DESCRIPTION OF THE PREFERRED EMBODIMENTS

Figure 1:
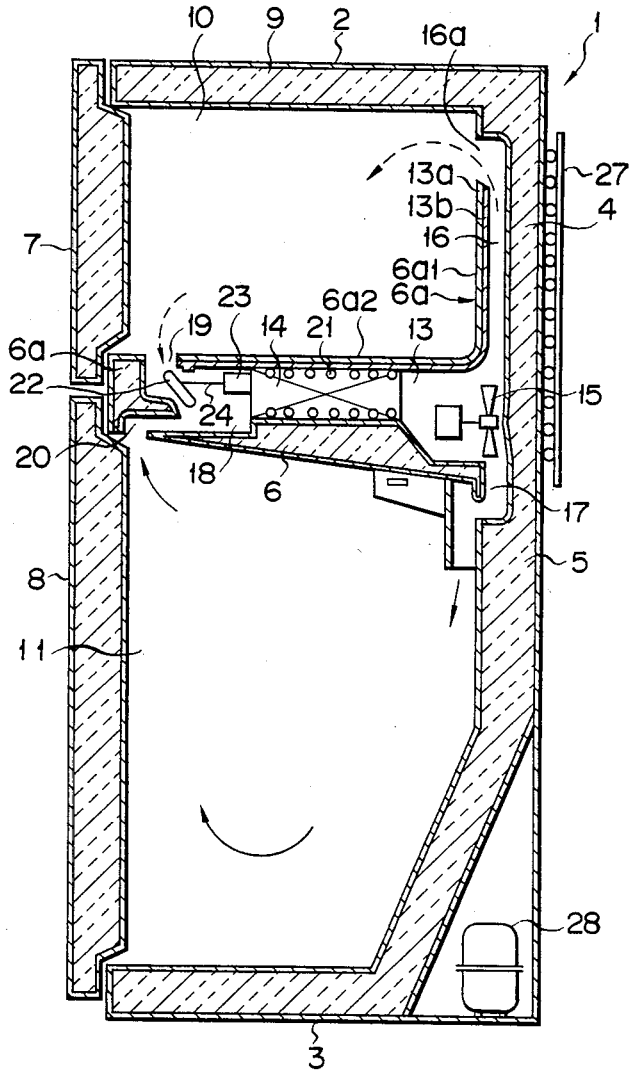
FIG. 1 is a longitudinal sectional view showing a refrigerator with a freezing chamber according to a first embodiment of the present invention.

In FIG. 1 showing a first embodiment of a refrigerator with a freezing chamber of the present invention, a housing 1 of the refrigerator has a top wall 2, a bottom wall 3, a first rear wall 4, a second rear wall 5, a partition wall 6, side walls, and openable doors 7, 8. Thermal insulators 9 are respectively filled in these walls. A freezing chamber 10 is formed in the upper inner space of the housing 1, and a storage chamber 11 is formed in the lower inner space of the housing 1. A cooling chamber 13 is provided adjacent to the freezing chamber 10. The cooling chamber 13 is formed of partition members 13*a*, 13*b* provided in the freezing chamber 10, the first rear wall 4 and the partition wall 6. An evaporator 14 is provided between the partition wall 6 and the partition member 13*b*. A convection fan 16 is provided to produce forced convection in the space formed between the partition member 13*b*, the partition wall 6 and the first rear wall 4. A first cooled air path 16 and a second cooled air path 17 which communicate with the cooling chamber 13 are provided in the right side of the evaporator 14 of the drawing. The first cooled air path 16 is formed between the partition member 13*b* and the first rear wall 4. The second cooled air path 17 is formed between the side of the partition wall 6 and the second rear wall 5. An intaken air path 18 is provided at the left side of the evaporator 14 of the drawing, and a first air intake hole 19 and a second air intake hole 20 which communicate with the path 18 are provided. A defrosting heater 21 for removing frost adhered to the evaporator 14, i.e., energized only at the defrosting time is provided at the evaporator 14. A damper plate 22 for opening and closing the first air intake hole 19, a drive mechanism 23 for the damper plate 22, and a rod 24 for connecting the damper plate drive mechanism 23 to the damper plate 22 are provided in the intaken air path 18. Reference numeral 27 designates a condenser which constructs a refrigerative cycle system (not shown) of the refrigerator shown, and numeral 28 is a compressor which similarly constructs the refrigerative cycle system.

Figure 2A:
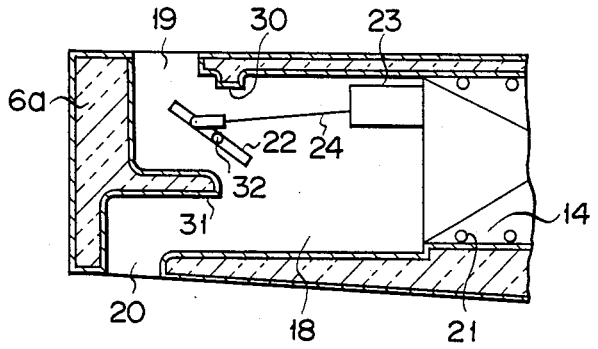
FIGS. 2A, 2B are sectional views of the forced air circulating path in FIG. 1.
Figure 2B:
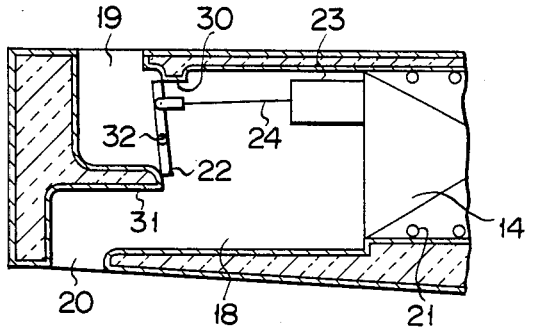
Figure 2C:
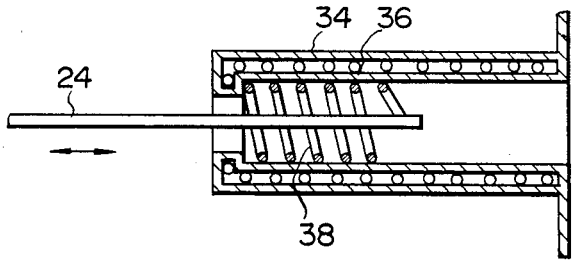
FIG. 2C is a sectional view of a camper plate drive mechanism.

The damper plate 22 and the drive mechanism 23 for the damper plate 22 will now be described in detail with reference to FIGS. 2A to 2C. A projecting portion 31 is provided at the end of the first air intake hole 19 of the partition member 13*b* and a projecting portion 31 is provided at the portion opposed to the projecting portion 30 of the partition wall 6*a*. The damper plate 22 is provided to rotate around a stationary shaft 32 as a center, to close the first air intake hole 19 in the vicinity of the projecting portions 30, 31 or to open the air intake hole 19 separate from the projecting portions 30, 31. A rod 24 for driving the damper plate 22 is connected between the damper plate 22 and the damper drive mechanism 23. FIG. 2A shows the case that the damper plate 22 opens the air intake hole 19, FIG. 2B shows the case that the damper plate 22 closes the air intake hole 19, and FIG. 2C shows the internal structure of the damper drive mechanism 23. This damper drive mechanism 23 has a metal double cylinder 34 formed of inner and outer cylinder members, a damper drive heater 36 insulated and wound between the outer and inner cylinder members and a spring-shaped shape memory alloy member 38 secured at one end to the bottom of the inner cylinder member and at the other to one end of the rod 24 extending toward the evaporator 14. The right end of the double cylinder 34 of the drawing is formed in a flange shape, and the flange portion is thermally contacted with the evaporator 14. When this spring-shaped shape memory alloy member 38 is heated to a temperature exceeding the status changing temperature of the shape memory alloy member 38 by means of a damper drive heater 36, the shape memory alloy member 38 extends axially of the coil in length stored in advance at the status changing temperature, and closes the first air intake hole 19, as shown in FIG. 2B. When the shape memory alloy member 38 is cooled to the status changing temperature or lower, the shape memory alloy member 38 contracts axially of the coil, and the damper plate 22 opens the first air intake hole 19 as shown in FIG. 2A.

An operation of the refrigerator shown in FIG. 1 will now be described. The energization of the defrosting heater 21 and the damper drive heater 36 and the driving of the convection fan 15 are controlled by a defrosting control circuit (not shown). When the defrosting control circuit receives a defrosting command signal, the control circuit controls to stop supplying refrigerant to the evaporator 14 during a predetermined period from the thus receiving time point, stop rotating the convection fan 15 and energize tbe defrosting heater 21 and the damper drive heater 36. The control circuit controls to supply the refrigerant to the evaporator 14 except the above predetermined period, rotate the fan 15 and stop the energization of the heater 21 and the heater 36.

The operation of the refrigerator in FIG. 1 of the case that the defrosting command signal is not applied to the defrosting control circuit will be as below. The refrigerant is supplied to the evaporator 14, the fan 15 is rotated, and the heaters 21 and 36 are cut off. In this case, since the spring-shaped memory alloy member 38 is cooled to the status changing temperature or lower, the memory alloy member 38 is contracted, and the damper plate 22 opens the first air intake hole 19, as shown in FIG. 2. Thus, a forced air circulating path which has the fan 15, the first cooled air path 16, the first cooled air exhaust hole 25, the freezing chamber 10, the first air intake hole 19, the intaken air path 18 and the evaporator 14 is formed. Since the air in the freezing chamber 10 is, therefore, cooled by the evaporator 14 while passing through the cooling chamber 13, the interior of the freezing chamber 10 is consequently cooled. When the freezing chamber 10 is thus completely cooled, the forced air circulating path which has the route of the evaporator 14, the fan 15, the second cooled air path 17, the storage chamber 11, the second air intake hole 20, the intaken air path 18 and the evaporator 14 is simultaneously formed. Therefore, the air in the storage chamber 11 is circulated through this route. Since the air in the storage chamber 11 is cooled while passing in the cooling chamber 13 in this manner, the storage chamber 11 is also cooled. As described above, an ordinary cooling operation is carried out in the refrigerator with a freezing chamber except the defrosting period. The compressor 28 is operated ON or OFF repeatedly during this ordinary cooling operation. The temperatures in the freezing chamber 10 and storage chamber 11 can be controlled by the known control system. In other words, the temperatures in the freezing chamber 10 and storage chamber 11 can be controlled by means of the control of the distribution of the flow rate of the air flowing in the freezing chamber and storage chamber and the ON and OFF of the compressor 28.

Frost is adhered to the surface of the evaporator 14 while the above-described cooling operation in the refrigerator is conducted. This frost can be removed as follows: A defrosting command signal is applied to a defrosting control circuit (not shown). The control circuit controls to stop supplying refrigerant to the evaporator 14 during a predetermined period from the reception of the defrosting command signal, stop the rotation of the fan 15 and energize the defrosting heater 21 and the damper drive heater 36. When the damper drive heater 36 is energized, the shape memory alloy member 38 is heated to the status changing temperature or higher. Therefore, the spring-shaped shape memory alloy member 38 will extend. Thus, as shown in FIG. 2B, the first air intake hole 19 is closed by the damper plate 22. On the other hand, the air of the evaporator 14 and hence the air in the cooling chamber 13 is raised at the temperature by the energization of the defrosting heater 21. Therefore, the frost adhered to the surface of the evaporator 14 is removed. Water droplets produced as a result of the removal of the frost from the evaporator 14 is exhausted externally of the refrigerator by known means per se. Since the first air intake hole 19 is closed by the damper plate 22, air convection occurring through the cooling chamber 13, i.e., the first cooled air exhaust hole 16*a*, the freezing chamber 10 and the first air intake hole 19 does not take place. Consequently, even if the temperature of the air in the cooling chamber 13 rises, the temperature of the air in the freezing chamber 10 does not rise. This means that the quality of foodstuffs contained in the refrigerator does not decrease even if the defrosting of the evaporator 14 is carried out while the foodstuffs are stored in the freezing chamber 10.

When a predetermined period of time is elapsed upon reception of the defrosting command signal by the defrosting control circuit so that the defrosting operation has completed, the control circuit controls to restart supplying the refrigerant to the evaporator 14, rotate again the fan 15 and restop energizing the defrosting heater 21 and the damper drive haater 36. As a result, the evaporator 14 and the shape memory alloy member 38 are respectively cooled again. When the shape memory alloy member 38 is cooled to the status changing temperature or lower, the spring-shaped shape memory alloy member 38 contracts axially. Thus, the first air intake hole 19 is again opened by the damper plate 22, as shown in FIG. 2A, and the cooling operation of the refrigerator restarts. In this case, the shape memory alloy has in general hysteresis characteristic of the temperature that the extending status changing temperature and the contracting status changing temperature are different. The spring-shaped shape memory alloy member 38 can control the damper plate 22 so as to maintain the damper plate 22 in the closed state while the evaporator 14 is not sufficiently cooled and to open the damper plate 22 after the evaporator 14 is sufficiently cooled. Thus, the air stored in the cooling chamber 13 and maintained at high temperature can be prevented from being introduced into the freezing chamber 10 when the cooling operation of the refrigerator is restarted.

Since the damper drive mechanism 23 is composed in a simple combination of the shape memory alloy member 38 and the heater 36 in the embodiment shown in FIG. 1, the damper drive mechanism can be reduced in size and inexpensively produced. As the heater (damper drive heater) 36 for heating the shape memory alloy member may be composed as part of the defrosting heater 21, the defrosting electric lower can be reduced.

Figure 3:
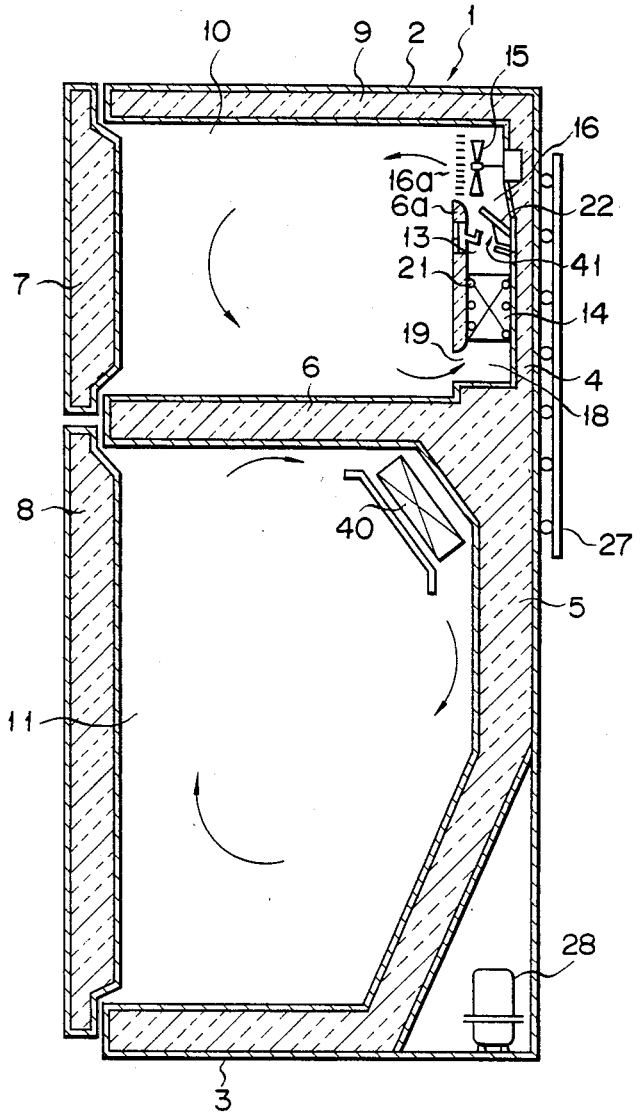
FIG. 3 is a longitudinal sectional view of a refrigerator with a freezing chamber according to a second embodiment of the present invention.

A second embodiment of the present invention will now be described with reference to FIG. 3. In FIG. 3, a housing 1 of the refrigerator has a top wall 2, a bottom wall 3, a first rear wall 4, a second rear wall 5, a partition wall 6, a sub-partition wall 6*a*, side walls, and openable doors 7, 8. Thermal insulators 9 are respectively filled in these walls. The inner space of the housing 1 is divided into a freezing chamber 10, a storage chamber 11 and a cooling chamber 13. The freezing chamber 10 is surrounded by the top wall 2, the partition wall 6, the sub-partition wall 6*a*, the door 7 and the side walls, the cooling chamber 13 is surrounded by the sub-partition wall 6*a*, the first rear wall 4, and part of the side alls, and the storage chamber 11 is surrounded by the partition wall 6, the bottom wall 3, the second rear wall 5, the door 8 and the side walls. A first evaporator 14 is provided in the cooling chamber 13, and a second evaporator 40 is provided in the upper space of the storage chamber 11. A compressor 28 is arranged in the lower space of the refrigerator housing 1 to contact external air. Reference numeral 27 designates, a condenser. The first evaporator 14, the second evaporator 40, the condenser 27 and a compressor 28 are connected in series with each other to construct a refrigerative cycle system. The refrigerative cycle system is controlled by an operation controller (not shown). More particularly, the operation controller controls the ON and OFF of the compressor 28, and controls so that the temperatures in the freezing chamber and storage chamber 11 become a set temperature.

A structure in the cooling chamber 13 will now be described in detail. An intaken air path 18 is formed in the lower part of the first evaporator of the drawing. An air intake hole 19 is opened between the intaken air path 18 and the freezing chamber 10, and the air is intaken in a direction as designated by an arrow in FIG. 3. A cooled air path 16 is formed in the upper part of the first evaporator 14 of the drawing. A damper plate 22 and a damper drive mechanism 41 are provided in the cooled air path 16. A fan 15 is provided in the cooled air path 16, and this fan 16 exhausts the cooled air through the cooled air exhaust hole 16*a* in a direction as designated by an arrow in FIG. 3.

Figure 4A:
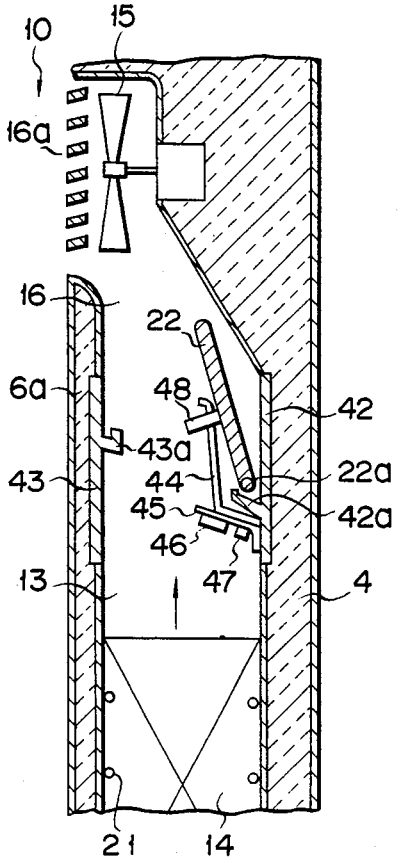
FIGS. 4A, 4B are partial sectional views of the forced air circulating path in FIG. 3.
Figure 4B:
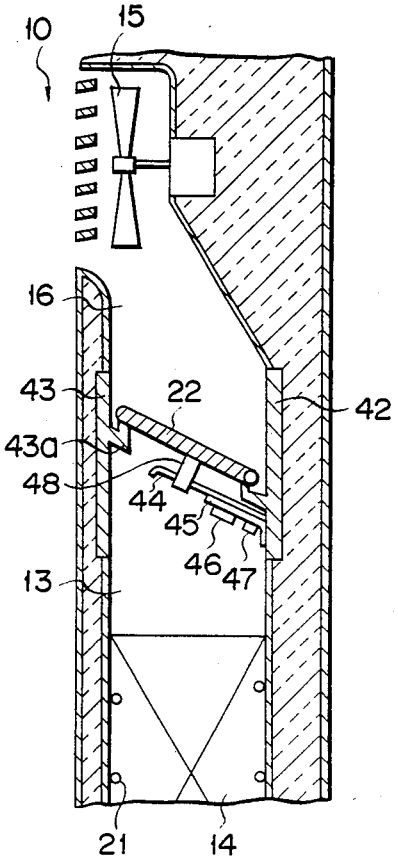

The damper plate 22 and the drive mechanism 41 for the damper plate 22 will be described in more detail with reference to FIGS. 4A, 4B. The damper plate and the damper drive mechanism supporting member 42 having a projecting portion 42*a* is fixedly secured to the inner surface of the first rear wall 4 in the cooling chamber 13. A damper supporting member 43 having a projecting portion 43*a* is fixedly secured to the inner surface of of the sub-partition wall 6*a* to the supporting member 42. The damper plate 22 is rotatable around a shaft 22*a* provided at one end of the damper plate 22 as a center. The damper drive mechanism 41 includes a heating plate 45, a heater 46 and a temperature sensor 47. The one end of the heating plate 45 is fixed to the supporting plate 42, and the heater 46 and the sensor 47 are provided on the lower surface of the extended part of the drawing. One end of a slender shape memory alloy member 44 is secured fixedly to the upper surface of the heating plate 45, aid the other end of the shape memory alloy member 44 is coupled through a member 48 to the lower surface of the damper plate 22. When the shape memory alloy member 44 is held at the status changing temperature or lower, the stationary end portion and the free end portion of the alloy member 44 form a predetermined angle as shown in FIG. 4A, the damper plate 22 is lifted by the free end portion of the member 44, and the damper plate 22 is disposed at the opened position. When the shape memory alloy member 44 is heated to the status changing temperature or higher through the heating plate 45 by means of the heater 46, the alloy member 44 displaces, as shown in FIG. 4B, so that the stationary end portion and the free end portion become a rectilinear line. Therefore, the damper plate 22 interrupts the communication between the cooling chamber 13 and the freezing chamber 10 in a manner supported by the damper plate 22 and the projecting portions 42*a*, 43*a*.

An example of a defrosting controller will now be described with reference to FIG. 5. The defrosting controller 50 as an integrating counter 52 for integrating a time period in which the motor 51 of a compressor 28 is being energized and outputting a logical "1" when the counter 52, for example, counts 8 hours, a switching circuit 53 for closing ON when receiving the signal of this logical "1" and continuing this ON state for a predetermined time period, for example, for 40 min., a temperature control circuit 54 of the shape memory alloy 44, receiving an output of the temperature sensor 47 and an output of the switching circuit 53 for controlling the energization of the heater 46 in response to the output of the sensor 47, a delay circuit 55, receiving the output (logical "1") of the integrating counter 52 for delaying the signal "1" by a predetermined period, for example, 5 min. to produce an output, a switching circuit 56 for turning ON by the output "1" of the delay circuit 55 for energizing the defrosting heater 21 of the first evaporator 14, and a timer 57 receiving the output signal "1" of the delay circuit 55 for producing a reset output after a predetermined period, for example, 30 min. to reset the integrating counter 52 by the reset output. The output "1" of the counter 52 is applied to the operation controller (not shown) of the refrigerator as a stop signal of the cooling operation control. The temperature control circuit 54 controls the ON and OFF of the input to the heater 47 so that the temperature of the shape memory alloy member 44 is maintained slightly higher than the temperature of the status changing temperature in response to the output of the temperature sensor 47.

An operation of the second embodiment of the refrigerator with a freezing chamber will now be described with reference to FIGS. 3, 4A, 4B, 5, 6. While the logical "1" is not dispatched from the integrating counter 52, the refrigerator is operated in cooling. At this time, the damper plate 22 is maintained in opened state as shown in FIG. 4A, and the fan 15 is continuously operated. In other words, the temperatures of the freezing chamber 10 and the storage chamber 11 are maintained to the set value by the ON and OFF control of the compressor motor 51. When the integrated value of the operating period of the motor 51 becomes, for example, 8 hours, the integrating counter 52 outputs a logical "1". As a result, the cooling operation of the refrigerator is stopped, and the supply of refrigerant to the evaporators 14, 40 and the operation of the fan 15 are stopped. When the counter 52 outputs the logical "1", the switching circuit 53 closes ON to flow a current to the heater 46. Consequently, the shape memory alloy member 44 is abruptly heated during the time period $t_1$ indicated by (T0–T1) in FIG. 6. When the shape memory alloy member 44 is then heated to the status changing temperature TM of the alloy memory 44 at the time point T1, the alloy member 44 displaces rectilinearly as shown in FIG. 4B, with the result that the damper plate 22 takes its closed position. The temperature sensors 47 detects the temperature of the alloy member 44, and controls the alloy member 46 with the result through the temperature control circuit 54 to maintain the alloy member 44 at a temperature slightly higher than the temperature of the status changing temperature of the member 44. Therefore, the alloy member 44 can be maintained in a rectilinear state as shown in FIG. 4B. Consequently, the freezing chamber 10 and the cooling chamber 13 are maintained in cut-off state. In this case, the alloy member 44 and the damper plate 22 are not heated to the temperature higher than required as shown by a broken line 58 in FIG. 6. The defrosting control circuit 54 will now be described in more detail. When the set time (e.g., 5 min.) (T0–T1) of the delay circuit 55 is elapsed, the switching circuit 56 closes ON to energize the defrosting heater 21. The damper plate 22 is already disposed at the closed state (in FIG. 4B) at the time point T1 when the switching circuit 54 is closed ON. The defrosting heater 21 is energized at the time period (T1–T2) (e.g., 30 min.). The evaporator 14 and hence the temperature in the cooling chamber 13 is raised at its temperature during the time period, and the frost on the surface of the evaporator 14 is externally exhausted as water droplets. Since the hot air in the cooling chamber 13 does not flow into the freezing chamber 10 due to the closed state of the damper plate 22, the quality of foodstuffs is not deteriorated even if the defrosting is executed while the foodstuffs are contained in the freezing chamber 10 in the same manner as in the first embodiment shown in FIG. 1.

The timer circuit 57 applies a reset signal to the integrating counter 52 to reset the counter 52 at the time point T2 in which the set time limit (e.g., 30 min.) of the timer 57 is elapsed from the starting time point T1 of the energization of the defrosting heater 21. Therefore, the heat 21 is deenergized at the time point T2, and the operation controller of the refrigerator switches the refrigerator to the cooling operation. In the defrosting control circuit shown in FIG. 5, in turn on period of the switching circuit 53 is set to 40 min, the delay time of the delay circuit 55 is set to 5 min, and the time limit of the timer circuit 57 is set to 30 min. Thus, the damper plate 22 is returned to the opened position shown in FIG. 4A at the time point T3 after the timer period $t_3$ (e.g., 5 min.) between the time points T2 and T3 shown in FIG. 6 is elapsed. This time point T3 is substantially the restarting time point of the cooling operation of the freezing chamber 10. In this invention, the $t_3$ between the time points T2 and T3 is called "closure extension period of the damper plate 22".

Figure 5:
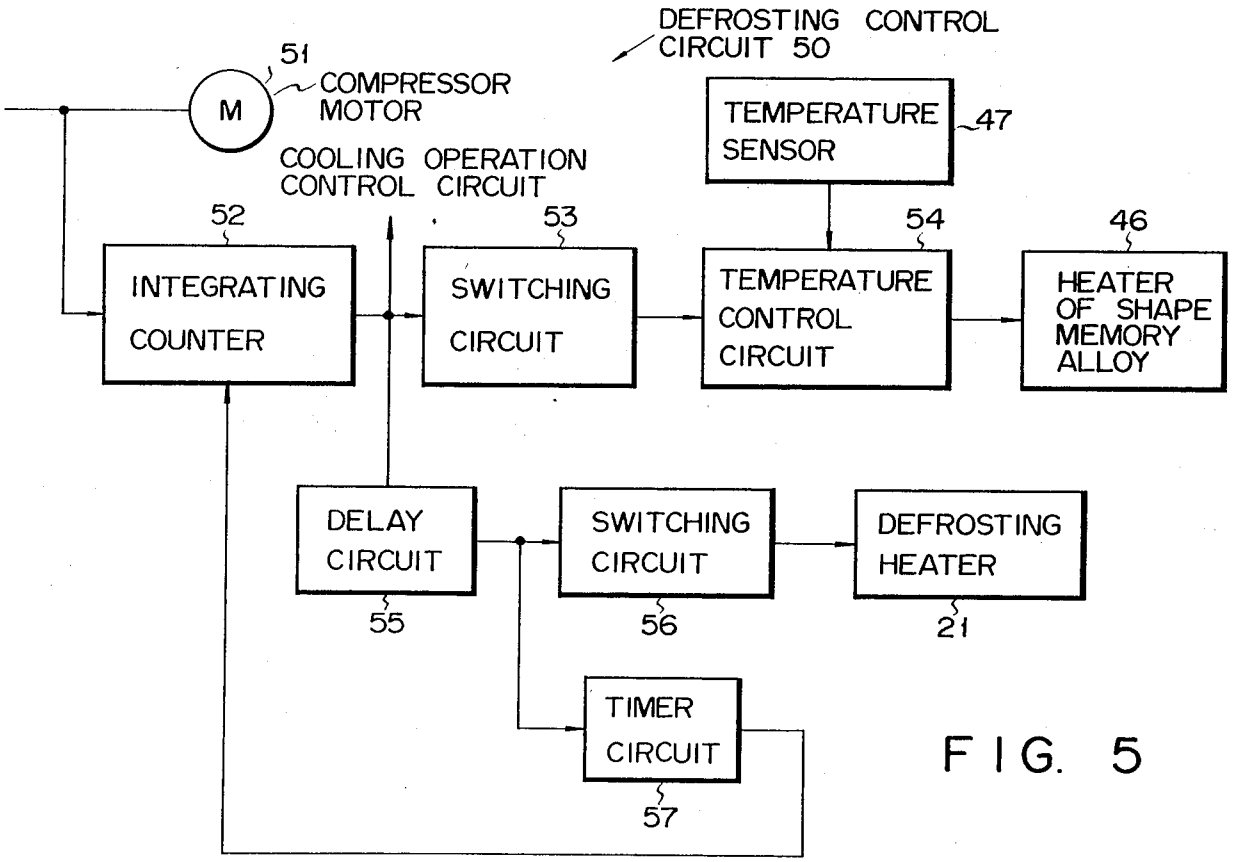
FIG. 5 is a block diagram of an example of a defrosting controller used for the refrigerator with a freezing chamber of the present invention.
Figure 6:
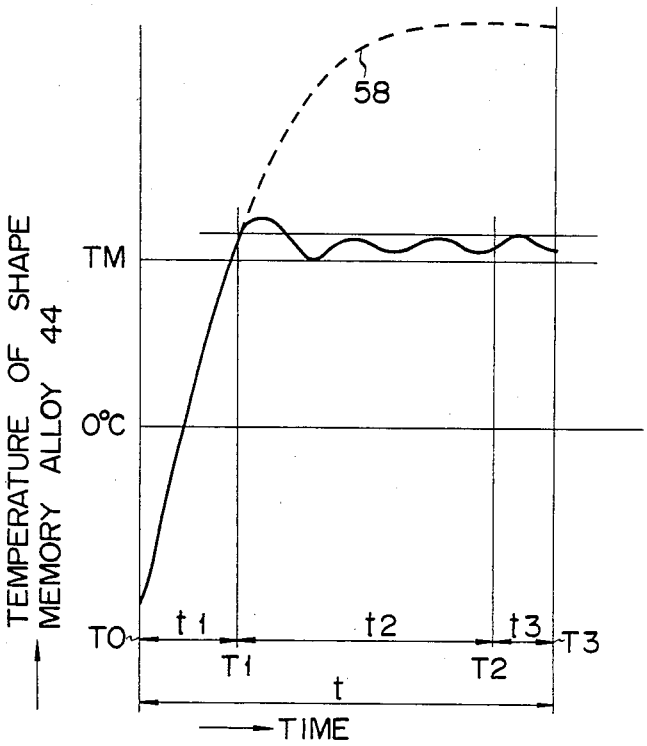
FIG. 6 is a view showing an example of temperature control characteristics of the shape memory alloy in FIG. 3.

In a refrigerator having a defrosting control circuit shown in FIG. 5, the shape memory alloy 44 can be rapidly heated to drive the damper plate 22 to take a closed position with the heater having a large capacity. The heating period of the heater 46 is a period $t_1$ which is immediately before the time $T_1$ in which the energization of the defrosting heater 21 starts. The temperature of the memory alloy member 44 is controlled to be slightly higher than the status changing temperature of the member 44 after the time point T1. Thus, the period of time to be taken for closing the damper plate is shorten and the freezing chamber 10 is not affected by the large power for controlling the damper plate.

Figure 7:
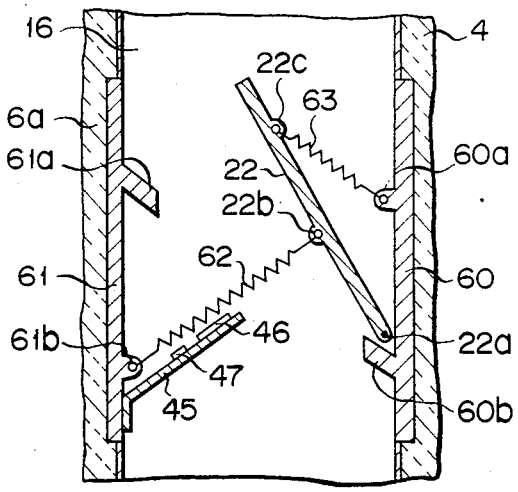
FIG. 7 is a partial sectional view of the cooled air circulating path for describing a third embodiment of the present invention.

FIG. 7 shows a third embodiment of the present invention. In the second embodiment (FIG. 3), a bidirectional shape memory alloy member 44 is employed as the drive mechanism 41 of the damper plate 22. In FIG. 7, a unidirectional shape memory alloy member 62 is, on the other hand, used to construct a drive mechanism for the damper plate. Tn FIG. 7, a supporting plate 60 is fixedly secured to the inner wall of a first rear wall 4, and a supporting plate 61 is fixedly secured to the inner wall of a sub-partition wall 6*a*. Projections 60*a*, 60*b* are formed on the supporting plate 60, and projections 61*a*, 61*b* are formed on the supporting plate 61. Fulcra 22*b*, 22*c* are formed at the damper plate 22 rotating at a shaft 22*a* as a rotating center. A spring-shaped shape memory alloy 62 is coupled between the fulcrum 22*b* of the damper plate 22 and the projection 61*b* of the supporting plate 61, and a bias spring 63 is coupled between the fulcrum 22*c* of the damper plate 22 and the projection 60*a* of the supporting plate 60. A heating plate 45 is fixedly secured at one end thereof to the lower portion of the projection 61*b* and extended at the other end along the spring-shaped shape memory alloy member 62. A heater 46 for heating the alloy member 62 and a temperature sensor 47 for detecting the temperature of the alloy member 62 are provided at the heating plate 45. When the alloy member 62 is maintained at the status changing temperature or lower, the alloy member 62 is in the stable to be extended, with the result that the damper plate 22 is disposed at the opened position as shown in FIG. 7 by the operation of the bias spring 63. However, when the alloy member 62 is heated to the status changing temperature the alloy member 62 is contracted. Therefore, the damper plate 22 is driven to the closed position, supported by the projections 60*b* and 61*a*, thereby cutting off the communication between the cooling chamber 13 and the cooled air path 56. Thus, the heater 46 can be controlled corresponding to the defrosting controller 50 which has the switching circuit 53 and the temperature control circuit 54 in FIG. 5. Further, the energization of the heater 46 may be controlled by using the defrosting controller which operates by the output of a defrosting thickness detector.

Figure 8:
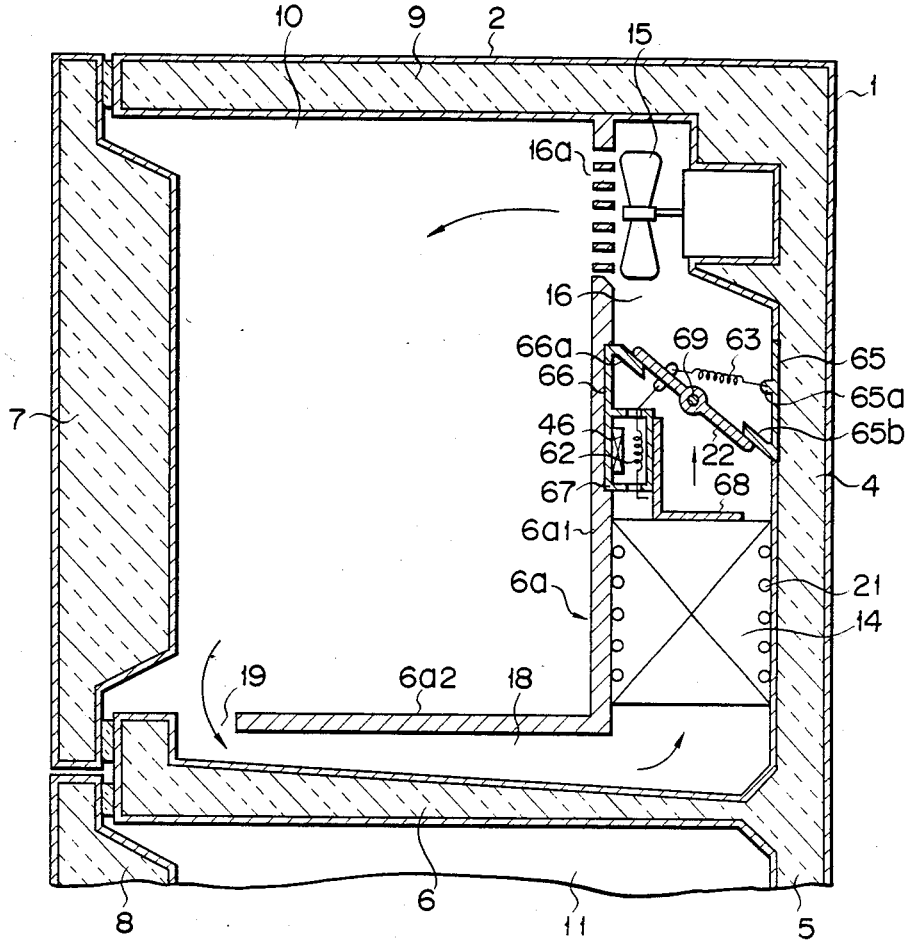
FIG. 8 is a view showing part of a longitudinal section of a refrigerator with a freezing chamber illustrating a fourth embodiment of the present invention.
Figure 9A:
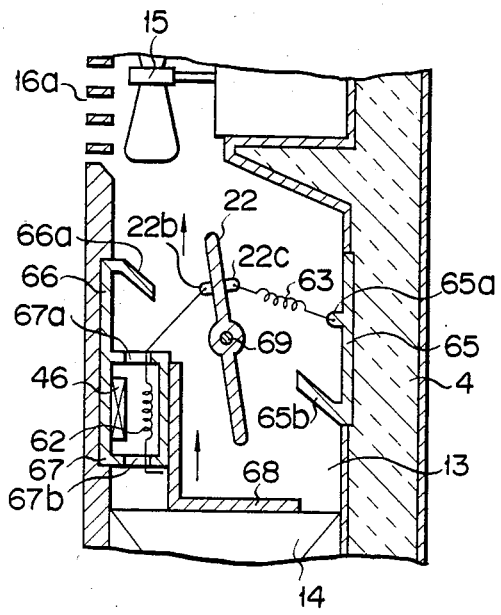
FIGS. 9A, 9B are sectional views showing part of the forced air circulating path in FIG. 8.
Figure 9B:
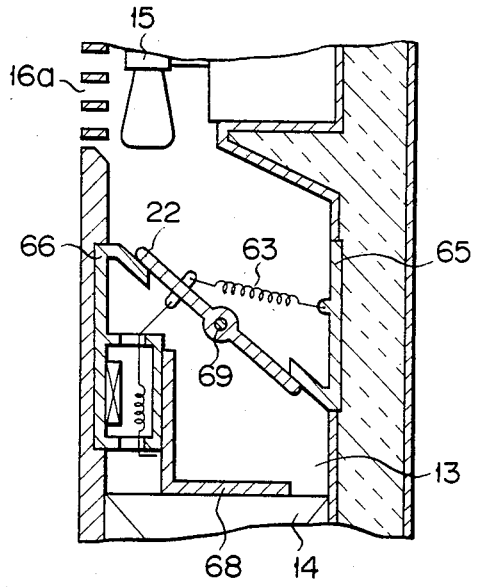

A fourth embodiment of the present invention will now be described with reference to FIG. 8. In FIG. 8, a housing 1 of a refrigerator with a freezing chamber has a top wall 2, a first rear wall 4, a second rear wall 5, doors 7, 8, a bottom wall (not shown), side walls, a partition wall 6 in the same manner as the embodiment shown in FIG. 3. The housing 1 also has a freezing chamber 10, a storage chamber 11, a first evaporator 14, a second evaporator in the same manner as the embodiment in FIG. 3. The same reference numerals as in the embodiments shown in FIGS. 3 and 4A, 4B denote the same parts in the fourth embodiment, and the detailed description thereof will be omitted. Only different members will be described in detail. A sub-partition wall 6*a* has a vertical portion 6*a*1 and a horizontal portion 6*a*2, and the horizontal portion 6*a*2 and the partition wall 6 form an air intake path 18 having an air intake hole 19. The first evaporator 14 is arranged between the lower portion of the vertical portion 6*a*1 and the first rear wall 4. A supporting plate 65 is secured fixedly to the inner surface of the first rear wall in the upper part of the evaporator 14 of the drawing, and a supporting plate 66 is fixed to the inner surface of the vertical portion 6*a*1 opposite to the supporting plate 65. Projections 65*a*, 65*b* are provided at the supporting plate 54. A projection 66*a*, is formed at the upper end of the supporting plate 66, and a vessel 67 is fixed to the lower end. This vessel 67 is formed of a thermally conductive material, and formed with vent holes 67*a* and 67*b*. The spring-shaped memory alloy member 62 and a damper control heater 46 for selectively heating the member 62 are provided oppositely to the member 62 in the vessel 67. This alloy member 62 is fixed at one end thereof to the vessel 67, and drawn out at the other end from the vent hole 67. This alloy member 62 is contracted at the status changing temperature or higher, and elongated at the status changing temperature or lower by the operation of a bias spring 63. The outer surface of the vessel 67 is thermally contacted, for example, with the cooling fin of the evaporator 14 through a thermally conductive heat conduction plate 68. A shaft 69 which extends horizontally at the position shown in the drawing is fixed in the cooling chamber 13, and the shaft 69 is inserted into the central portion of the damper plate 22 and held rotatably clockwise and counterclockwise. The bias spring 63 is coupled between the projection 65*a* of the supporting plate 64 and the fulcrum 22*c* of the damper plate 22, and the other end of the spring-shaped shape memory alloy member 62 is connected to the fulcrum 22*b* of the damper plate 22. FIG. 9A shows the case that the damper plate 22 is disposed at the opened position, and an arrow designates the direction of the flow of the air of this case. The defrosting heater 21 and the damper control heater 46 of the evaporator 14 are respectively connected to the defrosting control circuits (not shown). FIG. 9B shows the case that the damper plate 22 is disposed at the closed position. In this case, the lower surface of one end of the damper plate 22 is contacted with the upper surface of the projection 66*a*, the upper surface of the other end of the damper plate 22 is contacted with the lower surface of the projection 65*b*, and the surface of the damper plate 22 is inclined as shown.

An operation of the embodiment of the refrigerator shown in FIG. 8 will now be described. Since the shape memory alloy member 62 is at the status changing temperature or lower at the ordinary cooling operation time, the member 62 is disposed in the state capable of being extended. Therefore, the damper plate 22 is disposed at the opened position shown in FIG. 9A by the operation of the bias spring 63. When the temperature in the freezing chamber 10 is at the set temperature (set by a thermostat, not shown) or higher, the fan 15 is driven. Consequently, the air in the freezing chamber 10 is circulated in a closed loop of the freezing chamber 10, the intake hole 19, the intaken air path 18, the evaporator 14, the cooled air path 16, the cooled air exhaust hole 16*a* and the freezing chamber 10. In this manner, the freezing chamber 10 is cooled to a predetermined temperature.

The defrosting control circuit stops rotating of the fan 15 and energizes the defrosting heater 21 and the damper control heater 46 at the defrosting time. Therefore, the temperature in the vessel 67 rises. The shape memory alloy 62 is heated by the heated air in the vessel 67 and the radiation heat from the heater 46. Therefore, the alloy member 62 is heated to the status changing temperature or higher in a short time and contracted. Thus, the damper plate 22 is driven to the closed position shown in FIG. 9B. As a result, the heat energy by the energization of the defrosting heater 21 is stopped from being introduced into the freezing chamber 10.

When the defrosting is finished and the evaporator 14 is restarted, there occurs a difference between the temperature of the air around ths evaporator 14 and the temperature of the air in the vessel 67. Therefore, natural convection occurs through the vent holes 67*a*, 67*b*, and cooled air is introduced into the vessel 67. Consequently, the shape memory alloy member 62 is abruptly cooled and extended by the operation of the spring 63. As a result, the damper plate 22 is again driven to the opened position shown in FIG. 9A. When the fan 15 is then driven, the air is circulated as described above, and the interior of the freezing chamber 10 is cooled.

According to the fourth embodiment described above, the heating efficiency of the shape memory alloy member can be improved, and the cooling time of the shape memory alloy member can be shortened.

A fifth embodiment of the present invention will now be described with reference to FIGS. 10, 11A, 11B. The different points of the fifth embodiment in FIG. 10 from the fourth embodiment in FIG. 8 are that the upper surface of the projection 65*b* of the supporting plate 65 is inclined upwardly, while the upper surface of the projection 65*b* of a supporting plate 65 is inclined downwardly in FIG. 10; the heat conduction plate 68 is provided in FIG. 8, while the heat conduction plate is not provided in FIG. 10; and a quick cooling evaporator 72 is not provided in FIG. 8, while the quick cooling evaporator 72 is provided in FIG. 10. The same reference numerals as in the embodiments in FIG. 8 denote the same parts in the fifth embodiment in FIG. 10, and the detailed description thereof will be omitted.

Figure 10:
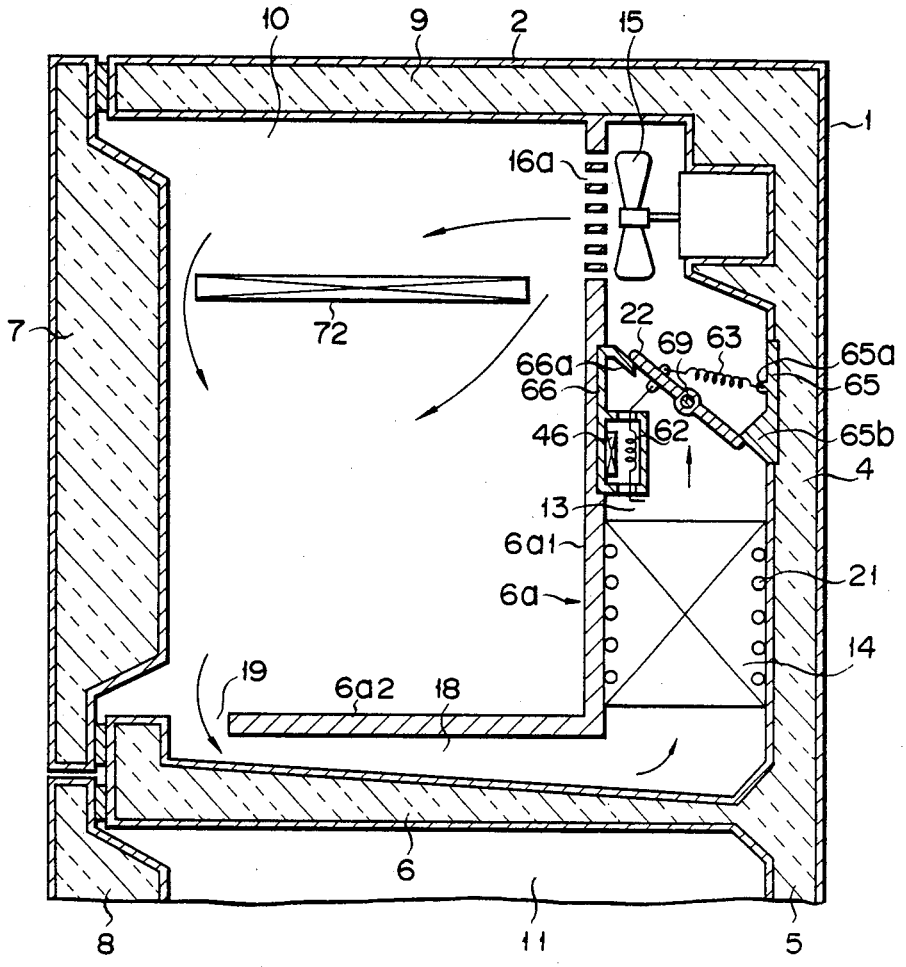
FIG. 10 is a view showing part of a longitudinal section of a refrigerator with a freezing chamber illustrating a fifth embodiment of the present invention.
Figure 11A:
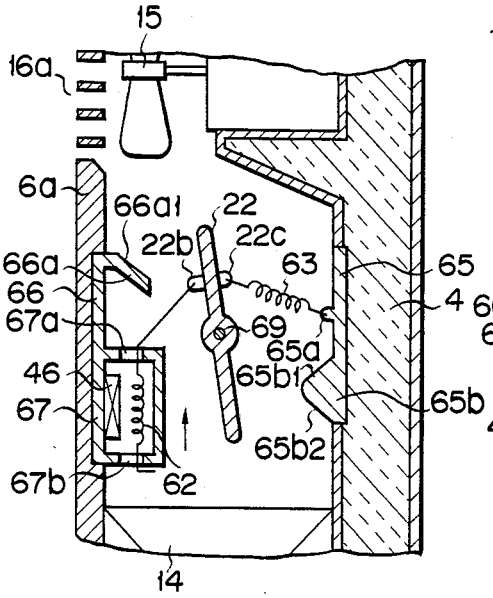
FIGS. 11A, 11B are sectional views showing part of the forced air circulating path in FIG. 10.

In FIG. 11A, the projection 65*b* of the supporting plate 65 and the projection 66*a* of the supporting plate 66 respectively operates as stoppers for stopping the counterclockwise rotation of the damper plate 22 of the drawing. In other words, the projection 65*b* stops the counterclockwise rotation of the damper plate 22 of the drawing at a predetermined position, and the projection 66*a* stops the counterclockwise rotation at a predetermined position. For example, the stopper 65*b* frequently rises at part of the plate state as shown in FIG. 9A. When such a stopper exists in the air circulating path, the stream of water produced at the defrosting time is disturbed by the stopper, with the result that smooth drain of water cannot be performed or the water is retained on the stopper. Therefore, when the ordinary cooling operation is started after the defrosting is finished, the water retained on the stopper is frozen, thereby obstructing the smooth operation of the damper plate 22. Or, a problem that a sealability is decreased due to insufficient contact between the projections 65*b*, 66*a* and the surface of the damper plate 22 has arisen. The embodiment shown in FIGS. 10. 11A, 11B has eliminated such a problem.

As shown in FIG. 10, the projection 65*b* is projected inwardly of the cooling chamber 13 with a triangular section shown in FIG. 10, and the upper surface 65*b*1 and lower surface 65*b*2 of the triangular section are inclined as shown. In other words, the inclination of the surfaces 65*b*1 and 65*b*2 are determined so that the water droplets are naturally flowed down along the surfaces 65*b*1 and 65*b*2 by the gravity. The upper surface 66*a*1 of the projection 66*a* is gradually inclined toward the inside of the cooling chamber 13. In other words, the surface 66*a*1 is inclined so that the water droplets can flow down by the gravity without stopping on the surface 66*a*1. Then, the height of the surface 66*a*1 is determined to be higher than the height of the surface 65*b*1. The damper plate 22 is stopped at the closed position by the projections 66*a* and 65*b* so as to satisfy the following conditions: The lower surface in the left end of the drawing of the damper plate 22 is contacted with the surface 66*a*1, and the upper surface of the right end of the drawing is stopped at the damper plate 22 in the state contacted with the surface 65*b*2. In this case, the damper plate 22 is obviously inclined from the left end to the right end of the drawing. Therefore, the surfaces of the damper plate 22 do not retain deposited water droplets but flow down the droplets by the gravity, and exhaust the water.

This embodiment provides additionally the advantage that water produced at the defrosting is smoothly exhausted, thereby obtaining the smooth operation of the damper plate and the damper plate is effectively sealed. The other advantages of this embodiment are in the same manner as the fourth embodiment shown in FIG. 8.

Figure 11B:
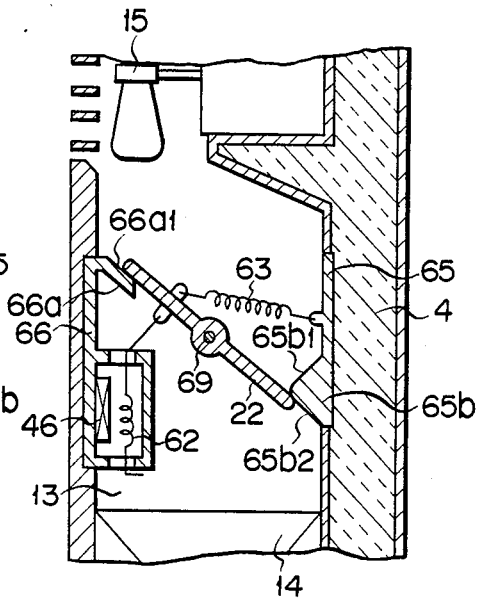
Figure 12:
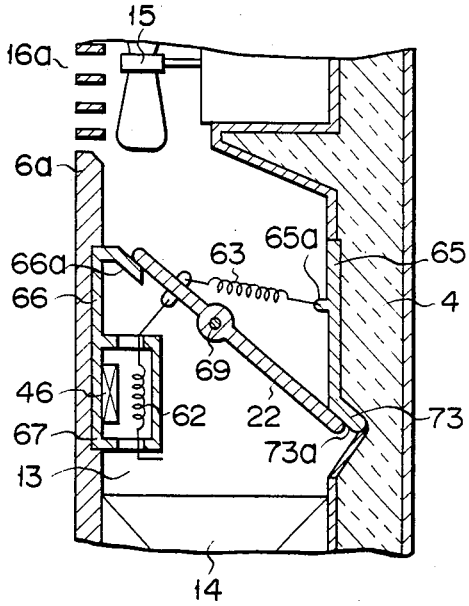
FIG. 12 is a view showing a modified example of FIG. 11B.

FIG. 12 show a modified example of FIG. 11B. In FIG. 11B, the first stopping portion 65*b* is projected toward the cooling chamber 13. In FIG. 12, a first stopping portion 73 is, on the other hand, introduced into the rear wall 4. However, since the surface 73*a* of the stopping portion 73 contacted with the upper surface of the damper plate 22 is inclined to flow down water droplets, the surface portion 73*a* is not frozen.

What is claimed is:

1. An indirect cooling refrigerator with freezing and storage chambers and a forced air circulating path comprising:

a freezing chamber;

a storage chamber; and a forced air circulating path provided between a rear wall of said freezing chamber and a partition wall provided facing said rear wall in said freezing chamber; wherein said forced air circulating path includes an air inlet for intaking air in said freezing chamber;

an inlet air path for passing said intaken air;

an evaporator for cooling said intaken air and having a defrosting heater;

a cooled air path for passing said cooled air;

an air outlet for exhausting said cooled air into said freezing chamber;

a convection fan for circulating air;

a damper plate provided in said cooled air path for opening and closing said forced air circulating path;

damper plate supporting means provided in said cooled air path for supporting said damper place in the opened and closed state; and a damper plate drive means including a shape memory alloy member which is provided in said cooled air path between said evaporator and said damper plate for driving said damper plate to the opened position at the cooling time of said freezing chamber and to the closed position when frost adhered to the surface of said evaporator is removed.

2. The refrigerator according to claim 1, wherein said forced air circulating path is provided between a rear wall of said refrigerator and a sub-partition wall provided oppositely to the rear wall in said freezing chamber of said refrigerator.

3. The refrigerator according to claim 1, wherein said shape memory alloy member is a bidirectional memory alloy having a first portion and a second portion;

said alloy member displaces so that the first portion and the second portion are disposed on a rectilinear line when heated to a predetermined temperature or higher; and same alloy member displaces so that the first portion and the second portion are disposed to hold at a predetermined angle smaller than 180° when heated to said predetermined temperature or lower.

4. The refrigerator according to claim 1, wherein said shape memory alloy member is a unidirectional alloy member formed in a spring shape;

said spring-shaped alloy member is contracted when heated to a predetermined temperature or higher, and is made extendable when cooled to said predetermined temperature or lower.

5. The refrigerator according to claim 3, wherein said damper plate and said damper plate supporting means are provided in the cooled air path of said air circulating path; said damper plate supporting means comprises first and second supporting members; the first portion of said shape memory alloy member is secured to said first supporting member to be heated by a heater; said second portion drives said damper plate to closed position when heated to said predetermined temperature or higher, and drives said damper plate to opened position when cooled to said predetermined temperature or lower.

6. The refrigerator according to claim 4, wherein said damper plate supporting means comprises a first supporting member fixedly secured to the one wall of the cooled air path and a second supporting member fixedly secured to the other wall; and said damper plate is biased to said first and second supporting plates by a bias spring and said spring-shaped shape memory alloy member, respectively so that said damper plate is disposed at the opened position when said spring-shaped shape memory alloy member is disposed in the state capable of being extended and at the closed position when said alloy member is disposed to contracted state.

7. The refrigerator according to claim 1, wherein the cooled air path of said forced air circulating path comprises said damper plate, said damper plate supporting means, said shape memory alloy member, an alloy member heating heater for heating said shape memory alloy member and a temperature sensor for detecting the temperature of said alloy member;

said shape memory alloy member is coupled to said damper plate to drive said damper plate to a closed position when heated to a predetermined temperature or higher;

said alloy member heating heater, said temperature sensor and said defrosting heater are connected to a defrosting control circuit;

said defrosting control circuit controls to heat said alloy member heating heater so that the temperature of said alloy member reaches said predetermined temperature from a first time point receiving a defrosting command signal to a second time point, to heat said defrosting heater from said second time point to a third time point, and to simultaneously heat said alloy member heating heater in response to an output of said sensor so that the temperature of said alloy member is maintained slightly higher than said predetermined temperature, thereby preventing the energy of said defrosting heater from being introduced into said freezing chamber.

8. The refrigerator according to claim 6, wherein said defrosting control circuit further comprises means for heating said alloy member heating heater from said third time point to a fourth time point so that the temperature of said alloy member is maintained slightly higher than said predetermined temperature, thereby preventing the heat energy produced by said defrosting heater immediately after the defrosting is completed from being introduced into said freezing chamber.

9. The refrigerator according to claim 1, wherein said shape memory alloy member is a unidirectional alloy member formed in a spring shape; said spring-shaped alloy member is in the state capable of being extended when heated to a predetermined temperature or higher and contracted when cooled to said predetermined temperature or lower.

10. The refrigerator according to claim 8, wherein said damper plate is provided to open and close said air intake hole at a shaft provided in the air intake hole of said air circulating path as a rotating center;

said damper drive means comprises a cylindrical member fixed at one end thereof to the air intake end of said evaporator and having at the other thereof a hole, wound with a shape memory alloy member heating heater therearound, said spring-shaped shape memory alloy supported at one end thereof to the hole end of said cylindrical member and disposed at the other thereof in said cylindrical member so that the other end thereof extends toward said evaporator, and a rod connected at one end thereof to the other end of said shape memory alloy, coupled at the other thereof to said damper plate for driving said damper plate to a closed position when said alloy member is extended and to an opened position when said alloy member is contracted.

11. The refrigerator according to claim 9, wherein said shape memory alloy heating heater and said evaporator defrosting heater are energized or deenergized synchronously.

12. The refrigerator according to claim 4, wherein said damper plate surrounding means comprises a first supporting member fixedly secured to a first wall of said cooled air path, and a second supporting member fixedly secured to an opposed second wall to said first wall;

said damper plate drive means comprises a vessel fixed to the lower end of said second supporting plate and having a lower vent hole and an upper vent hole, said spring-shaped shape memory alloy member contained in said vessel, and an alloy member heating heater provided in said vessel so that said shape memory alloy is heated;

said alloy member is fixedly secured at one end thereof to the vicinity of said lower vent hole, and coupled at the other thereof to said damper plate through said upper vent hole;

said damper plate is driven to an open position when said alloy member is extended and to a closed position when contracted.

13. The refrigerator according to claim 11, wherein said vessel is coupled to said evaporator by means of a heat conduction member.

14. The refrigerator according to claim 1, wherein said damper plate supporting means comprises a first supporting plate fixedly secured to a first wall of said cooled air path and having a first stopping portion for stopping the rotating of said damper plate, and a second supporting plate fixedly secured to a second wall opposed to said first wall of said cooled air path and having a second stopping portion for stopping the rotation of said damper plate;

said shape memory alloy member is a spring-shaped alloy member contracted at a predetermined temperature or higher and extended at said predetermined temperature or lower;

said damper plate is biased to be supported at the center thereof to a stationary shaft of horizontal direction at the center thereof, to be disposed at an opened position upon clockwise rotation when said alloy member is extended and to be disposed at a closed position upon counter clockwise rotation when said alloy member is contracted;

when said damper is disposed at said closed position the upper end of one end of said damper plate is contacted with the lower surface of said first stopping portion, the lower surface of the other end is contacted with the upper surface of said second stopping portion, and the horizontal positions of said first and second stopping portions are set so that said damper plate is inclined to a horizontal surface;

the surface shapes of said first and second stopping portions are formed so that water droplets produced when said damper plate is disposed at the closed position are naturally flowed along said first and second walls, and the surfaces of said first and second stopping portions to be contacted with said damper plate when said damper plate is disposed at the opened position are not frozen.

* * * * *